United States Patent [19]

Fischer

[11] Patent Number: 4,974,388

[45] Date of Patent: Dec. 4, 1990

[54] CASING FOR MAKING CONCRETE CONSTRUCTION COMPONENTS

[75] Inventor: Willibald Fischer, Dingolfing, Fed. Rep. of Germany

[73] Assignee: PECA-Verbundtechnik GmbH, Dingolfing, Fed. Rep. of Germany

[21] Appl. No.: 215,158

[22] Filed: Jul. 5, 1988

[30] Foreign Application Priority Data

Jul. 27, 1987 [DE] Fed. Rep. of Germany ..... 3723676

[51] Int. Cl.[5] ..... E04G 17/06

[52] U.S. Cl. ..... 52/650; 52/426; 249/40; 249/33

[58] Field of Search ..... 249/33, 40, 42; 52/650, 52/648, 694, 695, 426

[56] References Cited

U.S. PATENT DOCUMENTS

| | | | |
|---|---|---|---|
| 646,502 | 4/1900 | O'Shea | 52/335 |
| 1,671,946 | 5/1928 | Govan | 52/335 |
| 1,791,278 | 2/1931 | Lacy | 52/335 |
| 1,794,628 | 3/1931 | Eastman | 52/426 |
| 1,986,171 | 1/1935 | Wilson | 52/648 |
| 3,479,780 | 11/1969 | Schwarz | 52/694 |
| 3,555,751 | 1/1971 | Thorgusen | 52/426 |
| 4,290,985 | 9/1981 | Barale | 249/40 |
| 4,366,657 | 1/1983 | Hopman | 52/426 |
| 4,667,923 | 5/1987 | Lee | 249/42 |

FOREIGN PATENT DOCUMENTS

| | | | |
|---|---|---|---|
| 1089334 | 3/1955 | France | 52/426 |

*Primary Examiner*—Henry E. Raduazo

*Attorney, Agent, or Firm*—Finnegan, Henderson, Farabow, Garrett & Dunner

[57] ABSTRACT

A casing for making concrete construction components. The casing comprises at least one flat casing element consisting of a composite material with a metal grid as a carrier and at least one foil attached to this carrier. In order to improve a casing of this type in such a manner that an increased stiffness of the composite material employed as the casing is achieved while at the same time maintaining its lightweight construction for easy handling, the invention provides a stiffener element. The stiffener element is formed as a three-dimensional grid structure or grid girder comprising at least three longitudinal rods of structural steel extending in the longitudinal direction of the stiffener element and disposed side by side at spaced intervals. These longitudinal rods are interconnected by a plurality of cross members made of structural steel.

8 Claims, 6 Drawing Sheets

CASING FOR MAKING CONCRETE CONSTRUCTION COMPONENTS

The invention relates to a casing for making concrete construction components.

For the formation of concrete construction components of various types, particularly for making foundations, it is known to employ casings composed of casing elements made of a composite material consisting of a grid material (structural steel grid) as a carrier and at least one plastic foil (shrink foil) secured to said grid material. Specifically for making foundations or concrete griders it is known to employ a permanent casing comprising a casing element made by bending this composite material so as to obtain in the longitudinal direction of the casing a U-shaped cross-section defined by a pair of spaced parallel sidewalls and a bottom wall interconnecting the sidewalls, the latter being additionally interconnected by a plurality of spacers.

The described composite material is very useful for making casings for concrete components, particularly permanent casings of widely varying shapes adapted to any given purpose. Such casings are inexpensive and of low weight per unit surface area for easy handling. There is a certain disadvantage, however, due to the fact that the composite material has only a relatively low bending stiffness to oppose forces acting perpendicular to its surfaces, so that, in the case for instance of the above mentioned U-shaped casing element for making foundations or girders, a relatively great number of spacers is required. These spacers have to be arranged at relatively small spacings in the longitudinal direction of the casing and perpendicular thereto for preventing the casing from expanding under the weight of the concrete poured into the casing.

It is an object of the invention to improve a casing of the type defined above in such a manner that an increased rigidity is obtained for the composite material employed as the casing skin, while maintaining the lowest possible weight for easy handling.

For attaining this object, a casing is provided comprising at least one flat casing element consisting of a composite material with a metal grid as a carrier and at least one foil provided on said carrier, and at least one stiffener element for said casing element, characterized in that said stiffener element is formed as a three-dimensional grid structure or a grid girder comprising at least three longitudinal rods formed of structural steel and extending in the longitudinal direction of said stiffener element in a spaced side-by-side arrangement, and a plurality of cross members formed of structural steel and interconnecting said longitudinal rods.

Within the context of the invention, the term "three-dimensional grid structure or grid girder" is to be understood as denoting a structure comprising at least three longitudinal rods arranged to define the corner points of a triangle or quadrangle in a cross-section of the stiffener element.

The three-dimensional grid structure of the stiffener element is effective to substantially improve the stiffness of the at least one casing element, the stiffener element being also of inexpensive and low-weight construction, so that the casing as a whole may also be of inexpensive and low-weight construction for easy handling.

Specifically in the case of U-shaped casing elements used for making girders or foundations, the stiffener element permits the number of spacers to be reduced or the spacing of such spacers to be increased, resulting in considerable simplification of the construction of the casing at reduced costs for making a casing having the same stiffness.

In one embodiment of the invention, at least one stiffener element is secured to at least one casing surface formed by the casing element in such a manner that it extends in the longitudinal direction of the casing in contact with this surface.

In another embodiment of the invention, wherein at least two casing elements each defining a casing surface are disposed at a greater distance from one another, at least one stiffener element is provided, with its longitudinal dimension extending perpendicular to or across said surfaces between the two casing elements. In addition to this at least one stiffener element extending perpendicular to or across the surfaces of the casing, this embodiment preferably includes at least one further stiffener element on each surface, i.e. in contact with the respective surface and extending in the longitudinal direction of the casing element. If this embodiment is provided with a plurality of stiffener elements bridging the distance between the two casing elements or casing surfaces and extending perpendicular to these surfaces, the stiffener elements may aditionally be used as a support for an additional casing element formed of the same composite material and employed for the formation of an integral concrete slab or the like.

Further modifications of the invention are the subject matter of the subclaims.

The invention shall now be described in detail by way of example with reference to embodiments shown in the drawings, wherein.

Figure 1:
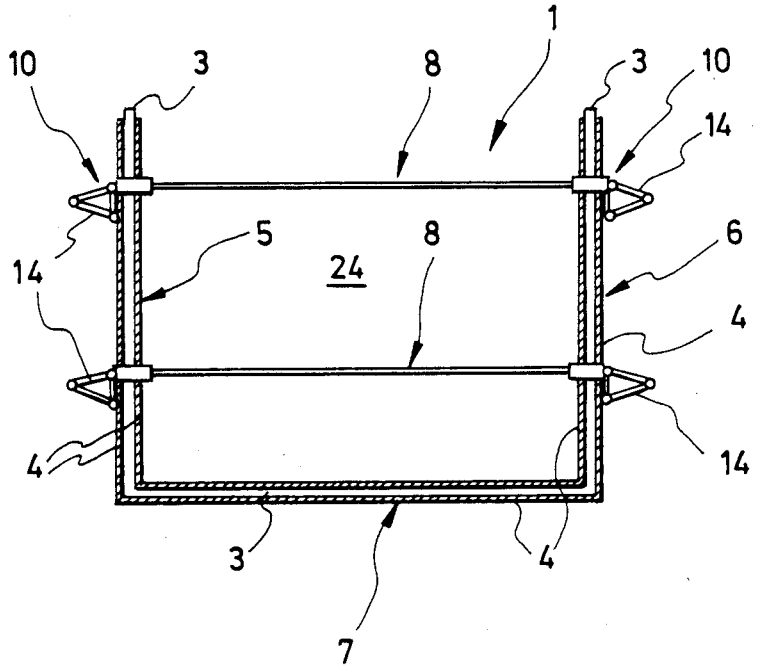
FIG. 1 shows a cross-sectional view of a casing according to the invention.
Figure 2:
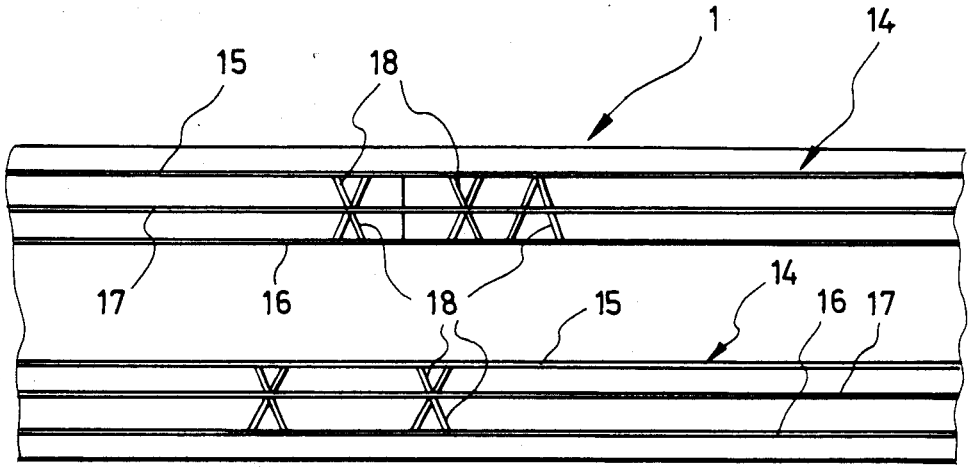
FIG. 2 shows a sideview of the casing showing in FIG. 1.
Figure 6:
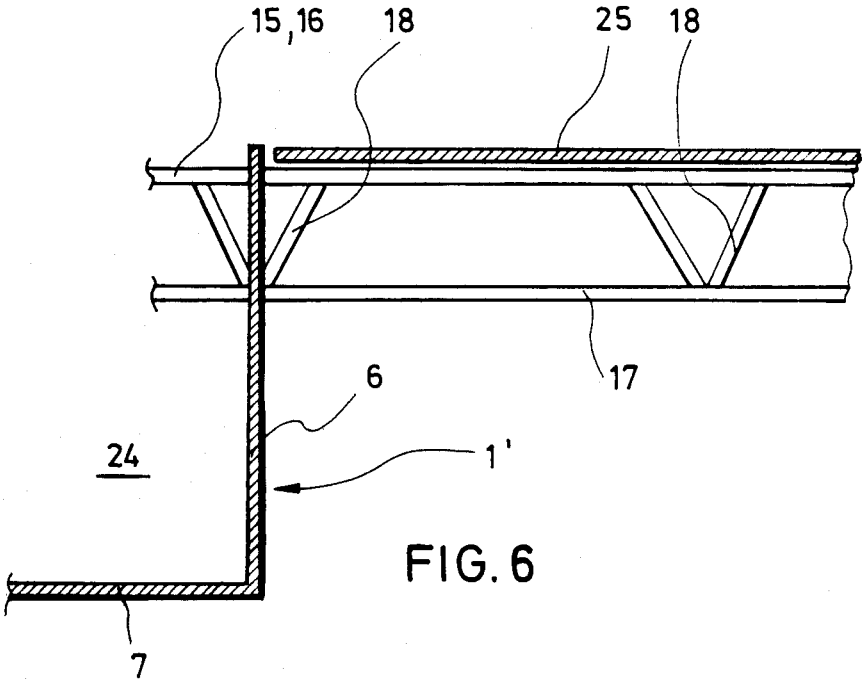
Figure 3:
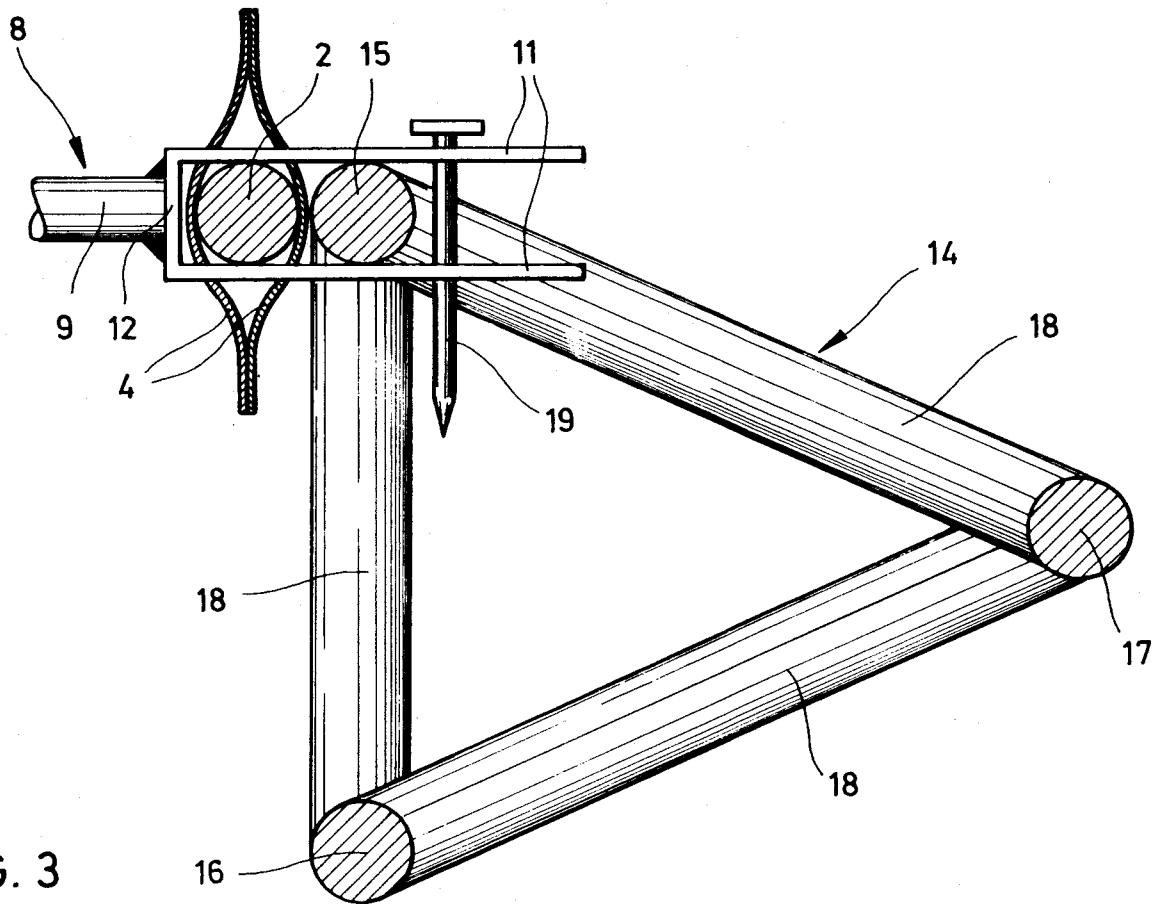
Figure 4:
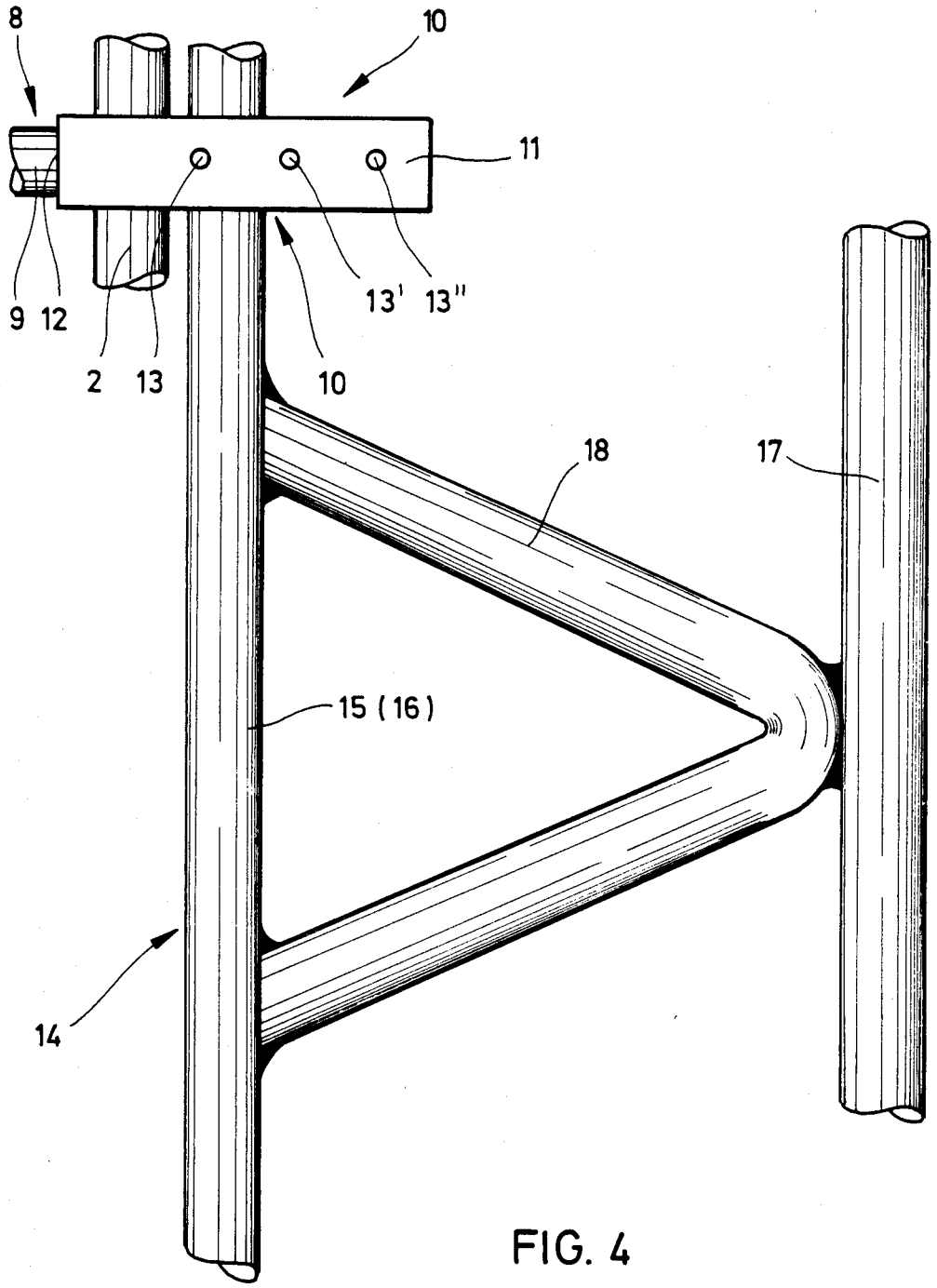
Figure 5:
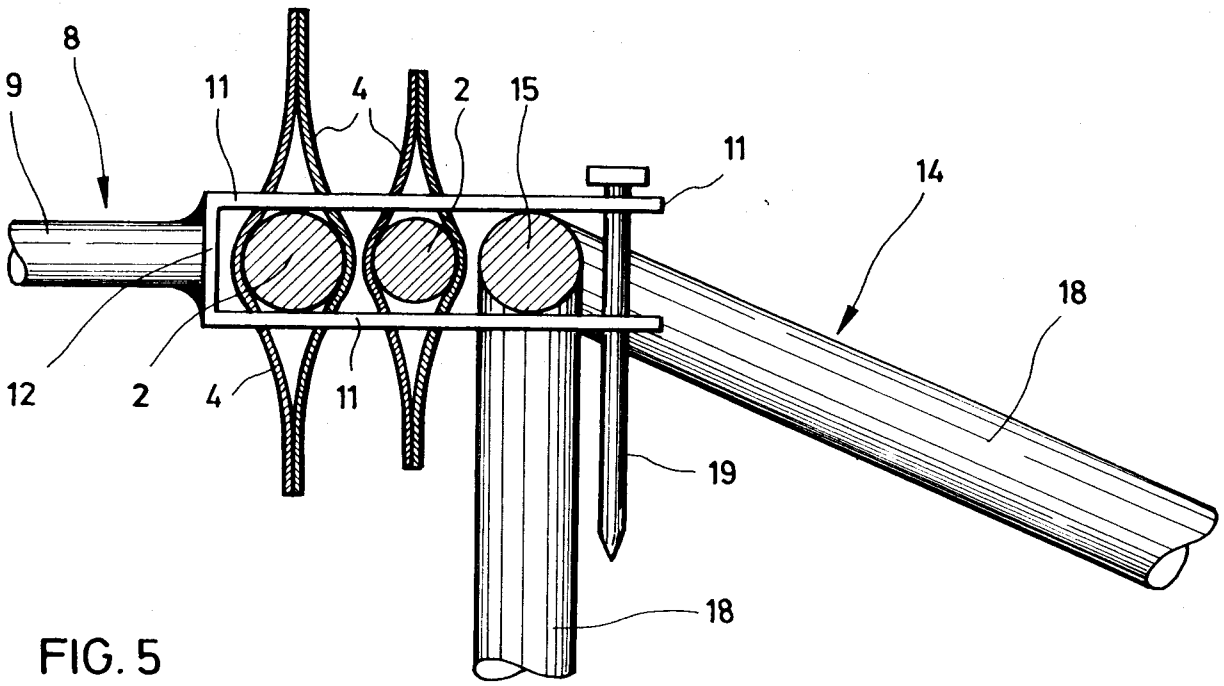
Figure 7:
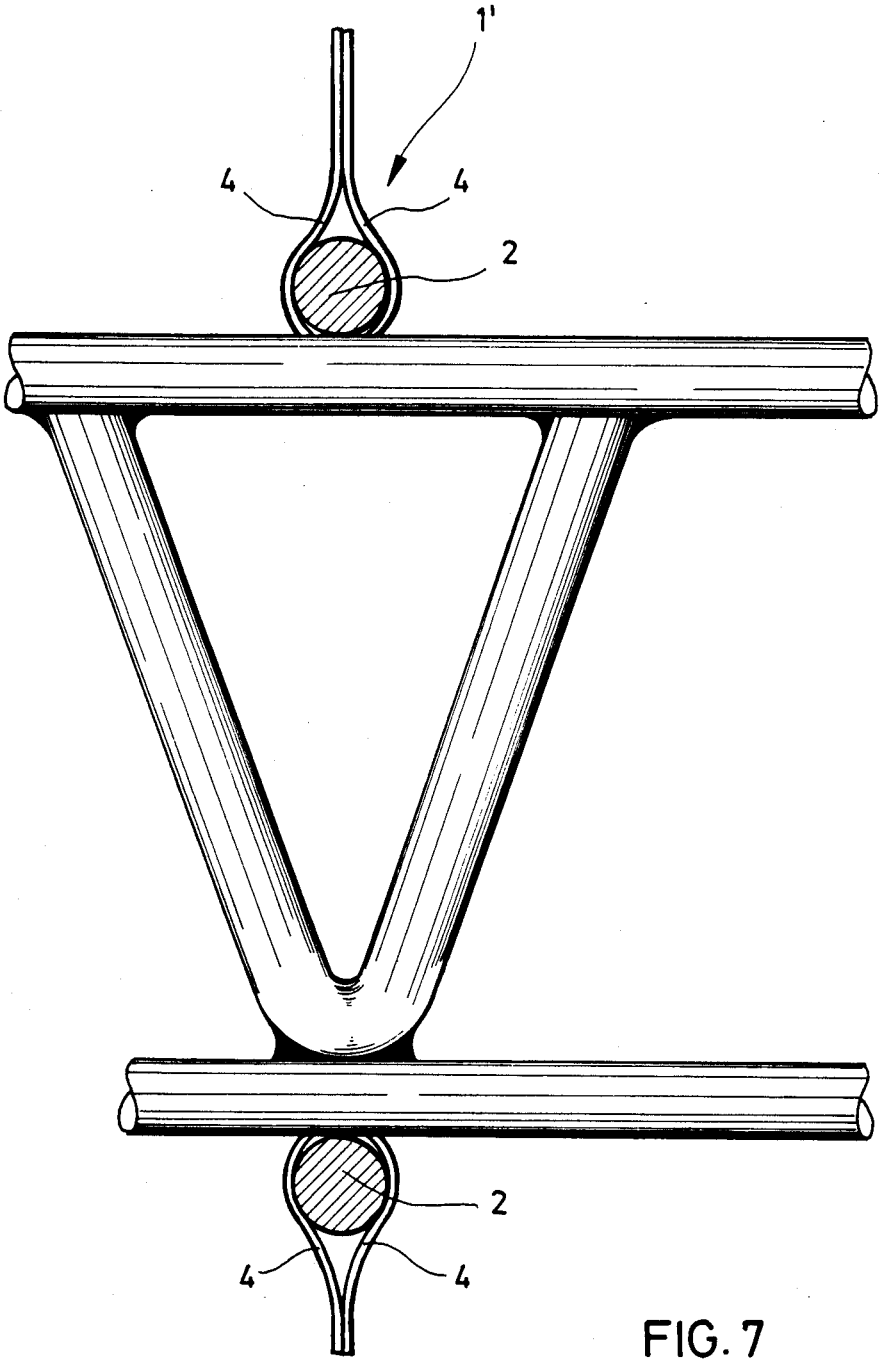

FIG. 3 shows an enlarged detail in vertical section of the casing element of the casing shown in FIG. 1, at the location of the connection of a spacer to the casing element, together with one of the stiffener elements provided on the outer surface of the casing element, FIG. 4 shows a top plan view of the detail shown in FIG. 3, FIG. 5 shows an illustration similar to FIG. 3, at the connection point, however, of two abutting casing elements, FIG. 6 shows a sectional view of part of a casing in another embodiment of the invention, FIG. 7 shows an enlarged detail in vertical section of the connection point between a casing element and a stiffener element in the casing shown in FIG. 6, and FIG. 8 is a conventional structural steel grid made of intersecting structural steel rods.

In the drawings, reference numeral 1 designates a casing element made by bending a composite material consisting of a grid structure or grid material as a carrier in the form of a conventional structural steel grid made of intersecting structural steel rods 2 and 3 secured to one another at the intersection points, and two plastic foils 4 shrink-bonded to opposite sides of the grid material so as to cover both sides thereof and to thereby close the grid openings of this material, the two foils being welded to one another at the locations of the grid openings.

Casing element 1, which may for instance be used for making concrete girders or foundations, is formed by bending the composite material to result in a U-shaped cross-section defined by two spaced vertical sidewalls 5 and 6, and a bottom wall 7 interconnecting the two sidewalls, the bent edges between sidewalls 5 and 6 and bottom wall 7 extending parallel to steel rods 2 and at right angles to steel rods 3 which have been bent at this location.

In order to impart the required stiffness to casing element 1, i.e. for preventing sidewalls 5 and 6 from being forced apart by the concrete poured into the casing cavity defined by sidewalls 5 and 6, a plurality of spacers 8 are provided to extend perpendicular to the sidewalls for rigidly connecting them to one another, spacers 8 being disposed vertically above one another and also at spaced locations in the longitudinal direction of casing element 1, i.e. perpendicular to the plane of FIG. 1.

Each spacer 8 consists of a rod-shaped element 9 of iron or steel having both of its ends formed with a forked end section 10 comprising two legs 11. The legs 11 of each end section 10 extend at a parallel spacing in the longitudinal direction of element 9. The length of each leg 11 is a multiple of the diameter of structural steel rods 2 and 3, in the example shown somewhat greater than three times the diameter of the structural steel rods. Forked end sections 10 may for instance be formed by bending a steel strip, and secured to respective ends of element 9 as by welding the cross member 12 interconnecting legs 11 thereto.

Each leg 11 is formed with a longitudinally extending row of bores 13, 13', 13'', each bore in one leg being concentrically aligned with a corresponding bore of the other leg 11. Legs 11 of end sections 10 penetrate the two plastic foils 4 so as to project from the outer surface of casing element 1. The legs 11 of each end section 10 also enclose a respective structural steel rod 2.

For rigidly supporting the composite material forming sidewalls 5 and 6 at locations between two longitudinally successive spacers 8, i.e. for preventing the casing sidewalls from being forced apart at this location, the embodiment shown is provided with two stiffener elements 14 disposed above one another on the outer surface of each sidewall 5 and 6 and extending in the longitudinal direction of the casing or casing element 1, respectively. Each stiffener element 14 consists of three longitudinal rods, for instance structural steel rods 15 to 17 extending in the longitudinal direction of stiffener element 14 and having the same diameter as structural steel rods 2 and 3 in the embodiment shown. Rods 15 to 17 extend parallel to each other in a spaced arrangement so as to define the corner points of an equilateral triangle in a cross-section of stiffener element 14, the base of this isoceles triangle being defined between rods 15 and 16, and its longer sides between rods 15 and 17 and 16 and 17, respectively. Steel rods 15 to 17 are interconnected by a plurality of V-shaped elements 18 likewise formed of structural steel, to result in a grid girder structure of stiffener element 14. Each stiffener element 14 is disposed on the outer surface of the respective sidewall 5 or 6 in such a manner that steel rods 15 and 16 are in contact with this outer surface or extend immediately adjacent thereto, steel rod 15 being disposed above steel rod 16 in the embodiment shown. To secure each stiffener element 14 to the respective sidewall 5 or 6, steel rod 15 is likewise received between the two legs 11 of spacers 8. A pen means such as a bolt or nail 19 passing through aligned bores 13' for instance of the respective end section 10 secures steel rod 15 and thus stiffener element 14 against dropping from end section 10 of the respective spacer 8.

Stiffener elements 14 have a particularly great inertial moment in the load-receiving direction, i.e. perpendicular to sidewalls 5 and 6, thanks to their described construction and arrangement on sidewalls 5 and 6, to thereby permit the distance between spacers 8 in the longitudinal direction of casing element 1, i.e. perpendicular to the plane of FIG. 1, to be greater than would be possible without the use of stiffener elements 14.

A further embodiment is shown in FIGS. 6 and 7. In this embodiment, a casing comprises at least two casing elements 1' disposed at a greater distance from one another and formed of the same composite material as casing element 1. In order to simplify the illustration, FIGS. 6 and 7 each show only one of the two casing elements 1' acting as part of a concrete pouring casing for making a concrete foundation. In the embodiment shown, casing element 1' is likewise of U-shaped cross-sectional configuration, so that two casing elements 1' of this type may be used for making two parallel and spaced girder foundations or respective foundation sections. The space between the two casing elements 1' is bridged by a plurality of stiffener elements 14 disposed in a row extending in the longitudinal direction of the casing elements, i.e. perpendicular to the plane of FIG. 6, with their longitudinal dimension extending perpendicular to the mutually facing sidewalls 6 of two casing elements 1', and their two ends projecting through the respective sidewalls 6 into the mould cavity 24 of the two casing elements to be filled with concrete. In the embodiment shown, stiffener elements 14 are disposed closely adjacent the upper longitudinal edges of casing elements 1'. They are secured in a suitable manner, for instance bound, to steel rods 2 and/or 3 of the sidewalls 6 of the two casing elements 1'. Stiffener elements 14 penetrate plastic foils 4 at the location of a grid opening or an enlarged opening formed by cutting a section from steel rods 2 and/or 3 at the location provided for receiving stiffener element 14. Stiffener elements 14 are thus effective to rigidly interconnect the two spaced casing elements 1'. After concrete has been poured into the cavities 24 of casing elements 1', all stiffener elements 14 are embedded in the concrete, so that after finishing the two girder foundations or foundation sections, it is possible to place a flat element 25, made specifically of the already described composite material, onto stiffener elements 14, this flat element being subsequently used as the horizontal bottom casing wall for a concrete slab to be subsequently formed. The casing shown in FIGS. 6 and 7 may thus be used as a permanent casing for the formation of concrete walls or foundations with an integrally formed ceiling slab or the like. In addition to the stiffener elements 14 bridging the space between casing elements 1', it is of course preferred to provide additional stiffener elements 14 extending along sidewalls 5 and 6 of casing elements 1' in the manner shown in FIGS. 1 to 5.

As shown in FIG. 5, spacers 8 or their end sections 10, respectively, may also be used for intersonnecting two adjacent casing elements 1 or 1', rexpectively, aligned in the longitudinal direction of the casing, i.e. perpendicular to the plane of FIG. 1, with their sidewalls 5 and 6 and bottom wall 7 overlapping one another for a short length. In this case, the two legs 11 of respective spacers 8 each receive two adjacent steel rods 2 of the overlapping portions of the two casing elements therbetween, together with steel rod 15 of stiffener element 14, in which case nail 19 is passed through bores 13" of the two legs 11 for securing the connection.

I claim:

1. A casing for making concrete construction components, comprising at least one casing element comprising a longitudinally extending metal grid made up of a plurality of intersecting bars and having at least one flat longitudinal side surface and at least one foil secured to said grid and at least one stiffener element for said casing element, said stiffener element being formed as a three-dimensional grid structure comprising at least three longitudinal rods of structural steel extending in the longitudinal direction of said stiffener element in spaced side-by-side relationship, and a plurality of cross members of structural steel interconnecting said longitudinal rods, said stiffener element being mounted on the longitudinal side surface of said metal grid by a plurality of fork elements, each element having two legs that clampingly engage a bar of the metal grid and a longitudinal rod of the stiffener element, and pin means interconnecting the two legs of each fork element to hold the stiffener element in place in such a manner that it projects laterally from said surface with at least one of said longitudinal rods of the stiffener element extending adjacent said surface.

2. The casing of claim 1, comprising two parallel spaced casing elements interconnected by a plurality of spacers, each spacer having both of its ends formed with said fork elements.

3. The casing of claim 2, including a casing element that interconnects the two parallel spaced casing elements to form a casing of U-shaped cross-sectional configuration.

4. The casing of claim 1, in which said stiffener element extends in the longitudinal direction of said casing.

5. The casing of claim 1, comprising at least a first and a second casing element arranged in spaced relationship, each element having at least one side surface facing each other and at least one additional stiffener element mounted on and extending perpendicularly between said facing side surfaces of said first and second casing elements.

6. The casing of claim 5, wherein said one additional stiffener element has a first end and second end, each of said ends projecting through said facing side surfaces of said first and second casing elements.

7. The casing of claim 1, wherein said stiffener element has three longitudinal rods extending in its longitudinal direction that define the corner points of a triangle in cross-section.

8. The casing of claim 7, wherein a first and second longitudinal rod extend adjacent said surface of said casing and a third longitudinal rod at a location spaced from said surface and wherein the distance between said first and second longitudinal rods is smaller than between each and the third longitudinal rod.

* * * * *

UNITED STATES PATENT AND TRADEMARK OFFICE

CERTIFICATE OF CORRECTION

PATENT NO. : 4,974,388

Sheet 1 of 2

DATED : December 4, 1990

INVENTOR(S) : Willibald Fischer

It is certified that error appears in the above-identified patent and that said Letters Patent is hereby corrected as shown below:

The sheet of drawing consisting of Fig. 8, should be added as shown on the attached page.

Signed and Sealed this

Nineteenth Day of January, 1993

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,974,388

DATED : December 4, 1990

INVENTOR(S) : Willibald Fischer

It is certified that error appears in the above-identified patent and that said Letters Patent is hereby corrected as shown below:

The following drawing should be included in the patent deed.

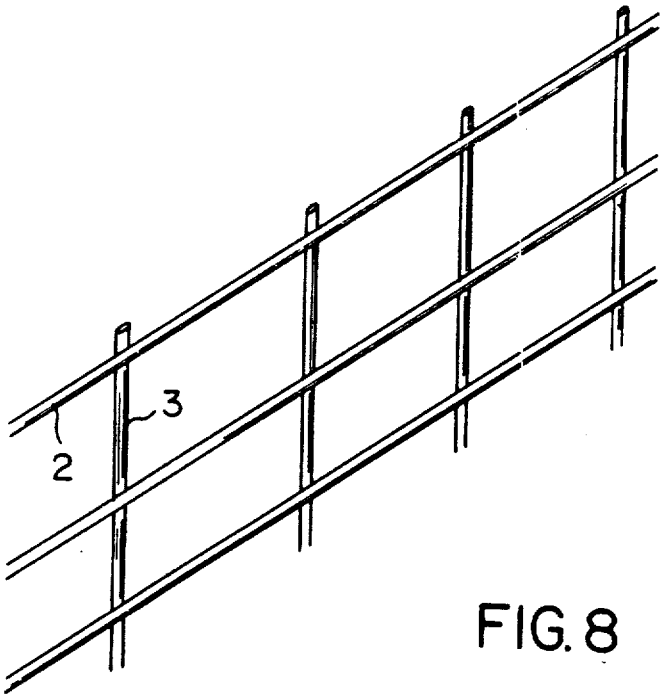

FIG. 8

Column 3, line 66, change "pen" to --pin--.